United States Patent [19]

Satake

[11] Patent Number: 5,025,993

[45] Date of Patent: Jun. 25, 1991

[54] SYSTEM FOR GRINDING GRAIN

[75] Inventor: Toshihiko Satake, Higashihiroshima, Japan

[73] Assignee: Satake Engineering Co., Ltd., Tokyo, Japan

[21] Appl. No.: 343,533

[22] Filed: Apr. 25, 1989

[30] Foreign Application Priority Data

Apr. 26, 1988 [JP] Japan ..... 63-104853

[51] Int. Cl.[5] ..... B02C 9/00; B02C 9/04

[52] U.S. Cl. ..... 241/74; 241/78; 241/77; 241/79.2

[58] Field of Search ..... 241/6, 7, 8, 9, 11, 241/12, 13, 24, 74, 76, 77, 78, 79, 79.1, 79.2

[56] References Cited

U.S. PATENT DOCUMENTS 2,879,004 3/1959 Dodds et al. ..... 241/7

3,519,431 2/1970 Wayne ..... 241/6 X 4,741,913 5/1989 Satake .

FOREIGN PATENT DOCUMENTS 471200 1/1951 Canada ..... 241/6

0218012 4/1987 European Pat. Off. .

0328666 9/1955 Japan .

*Primary Examiner*—Timothy V. Eley

*Attorney, Agent, or Firm*—Darby & Darby

[57] ABSTRACT

A grain grinding system includes a polishing machine for polishing grains, and roll mills and sifters for repeatedly mill and sift the polished grains to provide a flour having a desired mesh size. A moisture adding device is provided for adding moisture to the grains milled in at least one of the roll mills, thereby maintaining the grains in a suitably moistened condition during the milling operation.

13 Claims, 4 Drawing Sheets

SYSTEM FOR GRINDING GRAIN

BACKGROUND OF THE INVENTION

1. Field of the Invention

The present invention relates to a process of and a system for flouring grains such as wheat grains.

2. Description of Related Art

The grains such as wheat grains each includes an endosperm part which contains starch, gluten-parenchyma and an aleuron layer. The aleuron layer constitutes a surface layer of the endosperm part. The content of starch and gluten-parenchyma, i.e., the content of the endosperm part excepting the aleuron layer, is about 84.0% by weight of the grain, and the content of the aleuron layer is about 7.5% by weight of the grain. The endosperm part is covered with several layers which contain an exosperm layer adjacent to the aleuron layer, a testa layer covering the exosperm layer and a layer of pericarp outside the testa layer. The content of the surface portion of the grain including the layers of aleuron, exosperm, testa and pericarp is about 13.5% by weight of the grain. Further, the contents of the layers of pericarp and testa are about 4% and about 2%, respectively, by weight of the grain. The content of the exosperm layer is of very small weight percentage and almost negligible. The grain also includes embryo, the content of which is about 2.5% by weight of the grain.

In a grain flouring process, the grains are milled into powdery or pulverized grains, and endosperm parts except aleuron parts of the grains, i.e., starch and gluten-parenchyma parts, are separated from the materials of the surface portions of the grains which include pericarp, testa, exosperm and aleuron parts and have a large ash content. The endosperm parts except the aleuron parts, thus separated from the materials of the surface portions of the grains, are recovered as a powder or a flour. However, it is very difficult to completely separate starch and gluten-parenchyma from the materials of the surface portions of the grains. Ordinarily, the percentage (yield) of the resulting product (flour) in which the content of the materials of the surface portions is limited to a comparatively small value is about 75%.

In order to improve the milling efficiency and hence to enhance the yield in the process of flouring wheat grains, a pretreatment of adding moisture to the wheat grains and subjecting the same to conditioning is ordinarily performed. By this pretreatment, the moisture content of the wheat grains is increased from an original value of 11 to 13% to a value of 15 to 16%, the latter value being most suitable for milling. Namely, the wheat grains obtained by being selected, i.e., raw-material wheat grains, are moistened by means of a washer while being washed by the latter. Thereafter, the wheat grains are placed in a raw-material tank and are left at room temperature for 24 to 48 hours to allow water to gradually permeate into the wheat grains (tempering). After this moisture control, the wheat grains undergo conditioning for improving processibility of the grains while the latter are subject to the milling treatment and a secondary treatment, and then the wheat grains are moistened again before the milling treatment.

The conditioning is performed before milling in order to soften inner portions of the grains including starch and gluten-parenchyma and strengthen surface portions of the grains including layers of aleuron, exosperm, testa and pericarp, thereby preventing the surface portions from being damaged and facilitating the surface portions to exfoliate from the inner portions of the grains. However, the effects of addition of moisture based on tempering and conditioning prior to the milling step are reduced, since moisture is released from the inner portions and the surface portions of the grains during the milling step as the grains are broken and pulverized many times by means of roll mills and are passed through a plurality of sifters or sieves and a plurality of purifiers (air separation type purifiers). Exfoliation of the surface portions of the grains from the inner portions thereof thereby becomes difficult, and the surface portions are fractured finely. As a result, the surface portions cannot be completely separated from the inner parts, and hence the qualities of the resulting product are reduced.

SUMMARY OF THE INVENTION

It is therefore an obJect of the present invention to provide a grain flouring process of an improved efficiency.

It is another object of the invention to provide a grain flouring system for carrying out the process.

According to one aspect of the invention, there is provided a process of flouring grains comprising the steps of: polishing the grains to produce polished grains; repeatedly alternately milling and sifting the polished grains to provide a flour having a desired mesh size; humidifying the grains milled in the milling and sifting step; and recovering the flour.

The polishing step may include the steps of grindingly polishing the grains to partly strip and remove from each grain a surface portion of the latter including layers of pericarp, testa, exosperm and aleuron, and agitating the grains to bring the latter into frictional agitational contact with each other, thereby frictionally polishing the grains to further remove from each grain the surface portion thereof; and supplying moisture to the grains during the agitating step. Alternatively, the polishing step may include agitating the grains to bring the latter into frictional agitational contact with each other, thereby frictionally polishing the grains to partly strip and remove from each grain a surface portion of the latter including layers of pericarp, testa, exosperm and aleuron and grindingly polishing the grains to further remove from each grain the surface portion thereof.

The grains to be polished may be humidified prior to the polishing step, and they may undergo conditioning after the polishing step.

The surface portion of each grain to be removed in the flouring process includes layers of pericarp, testa, exosperm and aleuron as previously described, and it is preferable that the grains are polished in the polishing step in a manner to strip and remove from each grain the surface portion of the latter by an amount of at least 6% by weight of the grain. In other words, it is preferable to strip and remove from each grain the surface portion thereof at least to the extent that aleuron is exposed.

More preferably, the surface portions is removed to the extent that starch and gluten-parenchyma are exposed.

According to another aspect of the invention, there is provided a system for flouring grains comprising: pretreatment means including means for polishing the grains to produce polished grains; means for milling and sifting the polished grains to provide a flour having a desired mesh size; and means provided in association with the milling and sifting means for adding moisture to the grains milled in the milling and sifting means.

The milling and sifting means may include first milling means for milling the grains to form powdery grains, first sifting means for sifting the powdery grains and classifying the latter according to mesh size thereof, second milling means adapted to receive from the first sifting means the powdery grains of a predetermined mesh size and mill the grains received therein, and second sifting means for sifting the grains milled by the second milling means to provide the flour. In this case, the moisture adding means is provided in association with at least one of the first milling means and the second milling means.

The system may comprise purifying means including at least one purifier adapted to receive from the first sifting means the powdery grains of a predetermined mesh size and sort out from the powdery grains received therein the grains having large specific gravity and small mesh size. In this case, the second milling means is arranged to receive and mill the grains sorted out by the purifying means.

The first milling means and the first sifting means may include a plurality of roll mills and a plurality of sifters, respectively. In this case, the roll mills and the sifters are alternately arranged to repeatedly alternately mill and sift the grains. The moisture adding means may be connected to at lest one of the roll mills for supplying moisture directly into the at least one roll mill. Alternatively, the moisture adding means may be connected to a grain supply shoot for at least one of the roll mills for adding moisture to the grains passing through the grain supply shoot.

Similarly, the second milling means and the second sifting means may include a plurality of roll mills and a plurality of sifters, respectively. In this case, the roll mills and the sifters are alternately arranged to repeatedly alternately mill and sift the grains. The moisture adding means may be connected to at least one of the roll mills of the second milling means for supplying moisture directly into the latter at least one roll mill. Alternatively, the moisture adding means may be connected to a grain supply shoot for at least one of the roll mills of the second milling means for adding moisture to the grains passing through the latter grain supply shoot.

The moisture adding means may include a moisture adding device having an ultrasonic vibration element. Alternatively, it may include a binary fluid nozzle.

The polishing means may include a perforated polishing cylinder, and a grinding roll inserted into the polishing cylinder. In this case, the polishing cylinder cooperates with the grinding roll to define therebetween a polishing chamber.

The polishing means may include a grinding-type grain polisher having a grinding roll covered with emery, and a humidifying friction-type grain polisher having a moisture adding device for humidifying the grains introduced in a polishing chamber of the humidifying friction-type grain polisher. Alternatively, the polishing means may include a friction-type grain polisher having a frictionally polishing roll with agitating projections, and a grinding-type grain polisher having a grinding roll covered with emery.

The pretreatment means may include moisture supplying means for supplying moisture to the grains to be introduced and polished in the polishing means. Further, it may include conditioning means disposed between the polishing means and the milling and sifting means.

According to the process of the invention, the grains milled in the milling and sifting step are humidified. Similarly, according to the system of the invention, the moisture is added to the grains milled in the milling and sifting means. Thus, the grains are resupplied with an amount of moisture lost during the flouring operation.

According to an aspect of the invention, surface portions of the grains other than those located in furrow portions of the grains are at least partly separated by the polishing means arranged at the stage prior to the milling and sifting means. The grains are thereafter milled into powdery grains, classified according to mesh size or particle size thereof, sorted out according to the specific gravity and mesh size of the grains, and further milled and classified. Thus, the surface portions of the grains inclusive of those having been located in and attached to the furrow portions are further removed and the finished flour substantially free of materials of pericarp, testa, exosperm and aleuron is recovered.

In the case where the polishing is performed successively by the grinding-type grain polisher and the humidifying friction-type grain polisher, the grains are brought into contact with small cutting edges of the emery on the peripheral surface of the grinding roll rotating at a comparatively high speed, surface portions of the grains are scraped off by being broken into very small pieces mainly by the impacts, and surface portions (bran) still remaining on or attached to the grains are softened and removed together with moisture by humidifying friction-type grain polisher.

In the case where the polishing is performed successively by the friction-type grain polisher and the grinding-type grain polisher, hard trichomes and the like are removed from the surface of each grain by the effect of friction between the grains which is caused by agitation by means of the agitating projections of the polishing roll such that the grains are moved inside the polishing chamber under a comparatively high pressure, and surface portions of the grains are thereafter removed by being scraped off by the effect of collision with the grinding roll.

In the case where the pretreatment means includes the moisture supplying means, the raw-material grains with surface portions having been softened by the moisture supply are polished so that the surface portions are removed together with moisture. The grains may then undergo conditioning so that the moisture content may be adjusted to a value most suitable for the subsequent flouring operation and that the moisture distribution may become uniform.

The above and other objects, features and advantages of the invention will become more apparent from the following description with reference to the accompanying drawings.

DESCRIPTION OF THE PREFERRED EMBODIMENTS

Figure 1:
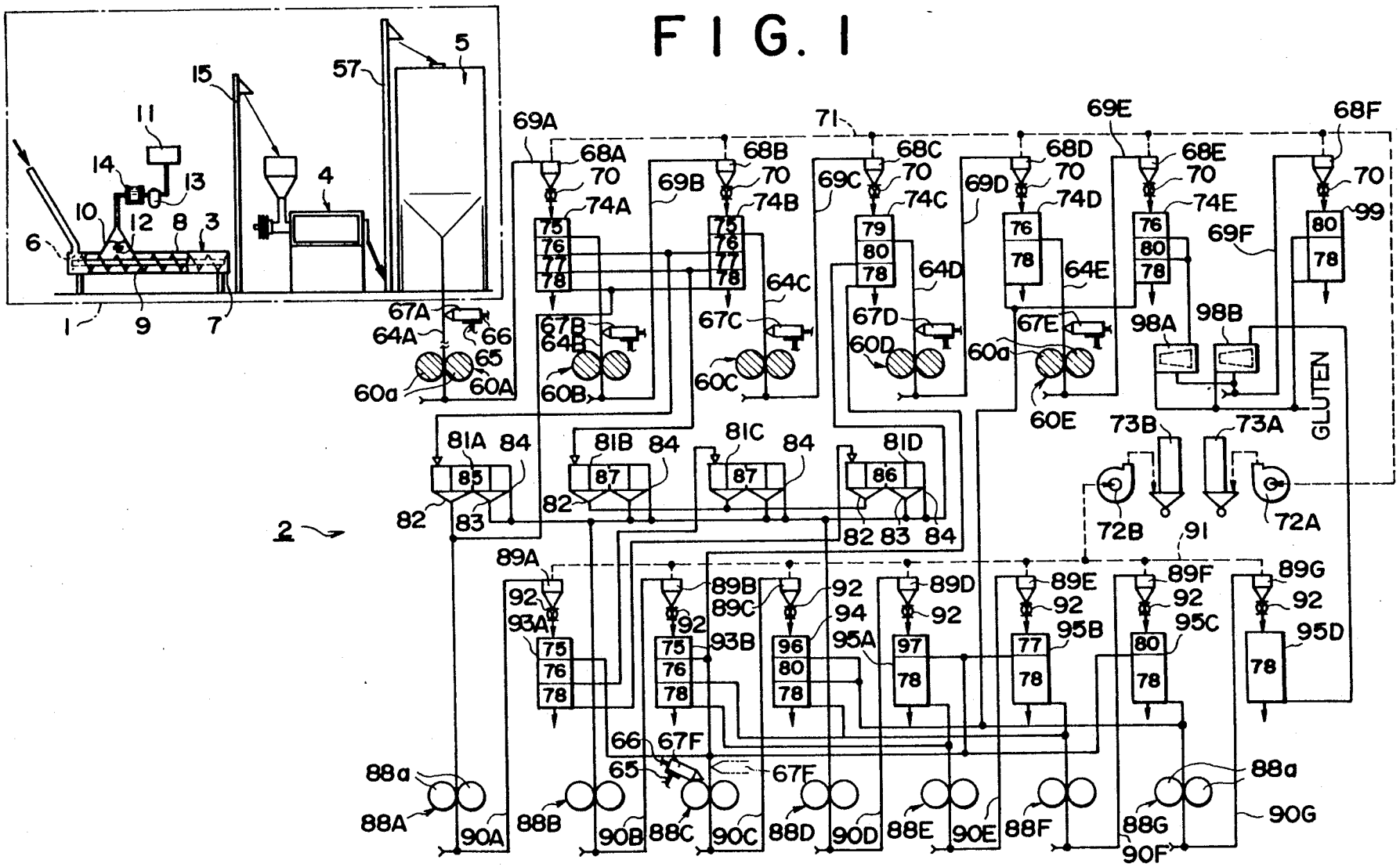
FIG. 1 diagrammatically shows a wheat flouring system constructed in accordance with an embodiment of the present invention.

A preferred embodiment of the present invention will be described below with reference to the accompanying drawings. Referring to FIG. 1, a pretreatment system 1 is constituted by a moisture supplying machine 3, a wheat polishing machine 4 and a conditioning machine 5. The moisture supplying machine (dampener) 3 is constituted by a through 8 having an inlet 6 and an outlet 7, a screw 9 laterally extending in the trough 8, and a moisture adding section 10 disposed at a side of the trough 8. A jet nozzle 12 connected to a water tank 11 is provided in the moisture adding section 10, thereby enabling addition of moisture to raw-material wheat in the trough 8. An electromagnetic valve 13 capable of regulating the flow rate of water and a heater 14 for heating water are provided at intermediate portions of a conduit which extends from the water tank 11 to the jet nozzle 12.

Figure 3:
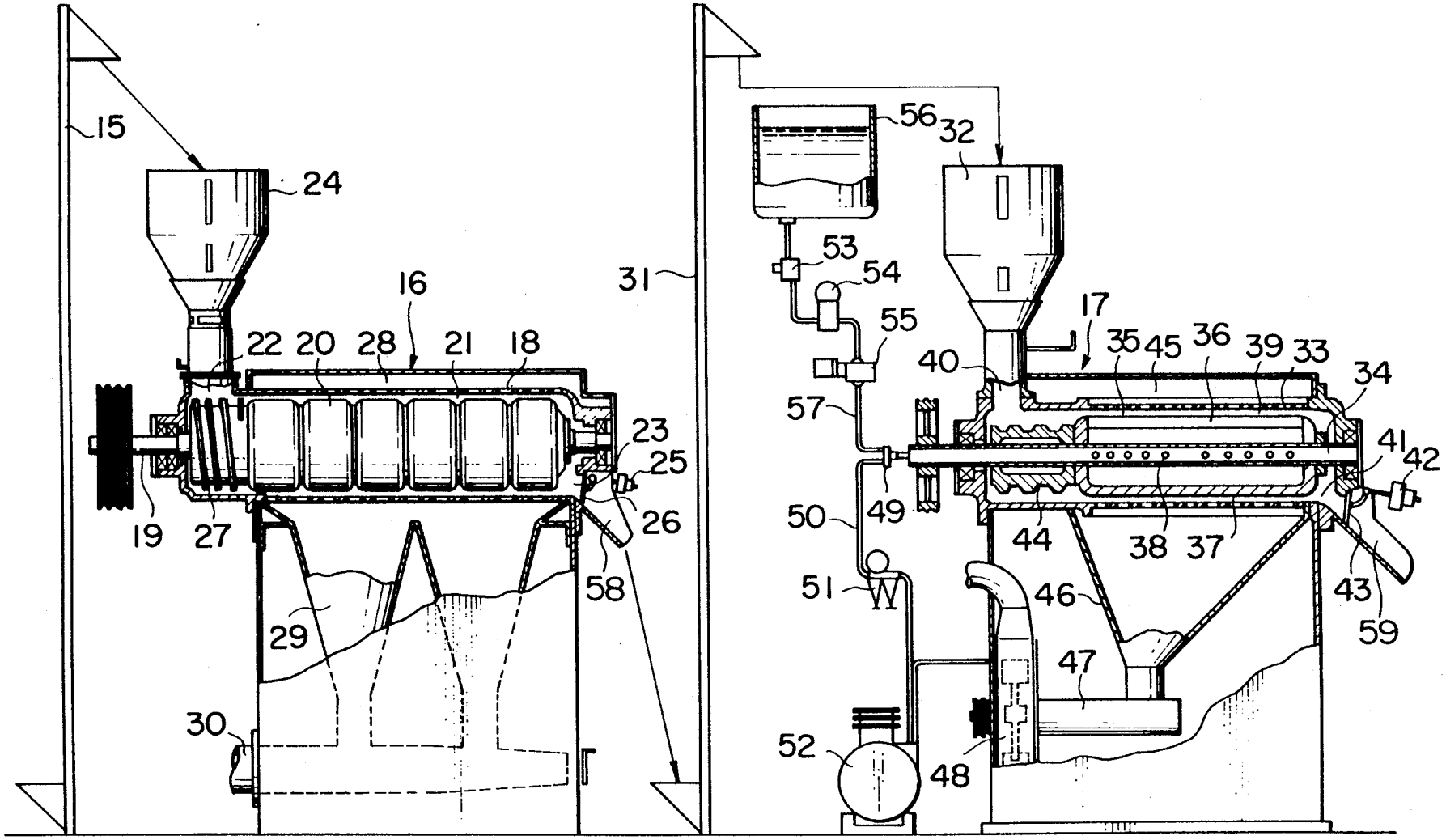
FIG. 3 is an enlarged cross-sectional view of a wheat polishing machine of FIG. 1.

The wheat polishing machine 4 (FIG. 3) is connected to the moisture supplying machine 3 by an elevator 15. The wheat polishing machine 4 in accordance with this embodiment is constituted by a grinding-type wheat polisher 16 and a humidifying friction-type wheat polisher 17. The grinding-type wheat polisher 16 is constructed as described below. A main shaft 19 passing through a perforated polishing cylinder 18 is disposed so as to be rotatable about a substantially horizontal axis. A grinding roll 20 having surfaces formed of emery is attached to the main shaft 19, and the perforated polishing cylinder 18 cooperates with the grinding roll 20 to define therebetween a polishing chamber 21. The polishing chamber 21 has an inlet 22 formed at its one end and an outlet 23 formed at its other end. A supply hopper 24 is disposed above the inlet 22, and a pressure plate 26 urged by a weight 25 is disposed at the outlet 23. A feeding roll 27 having a screw wing formed on its outer surface is attached to the main shaft 19 beneath the inlet 22. A bran collecting chamber 28 is formed on the outer periphery of the perforated polishing chamber 18, and a lower portion of the bran collecting chamber 28 is communicated with a bran collecting duct 30 via a bran collecting hopper 29. The bran collecting duct 30 is extended to a bag filter and an exhaust fan (not shown).

A discharge shoot 58 is provided at the outlet 23 of the grinding-type wheat polisher 16 to supply wheat grains to a supply hopper 32 of the humidifying wheat polisher 17 via an elevator 31. The humidifying friction-type wheat polisher 17 is constructed as described below. A hollow main shaft 34 passing through a perforated polishing cylinder 33 having a polygonal cross sectional shape such as, for example, a hexagonal shape is disposed so as to be rotatable about a substantially horizontal axis. A frictionally polishing roll 37 having agitating projections 35 mounted thereon so as to extend generally in the longitudinal direction and longitudinal slots 36 hollowed along the agitating projections 35 is attached to the hollow main shaft 34 which is open at its one end. The hollow shaft 34 has a multiplicity of air holes formed in its peripheral wall. The frictionally polishing roll 37 cooperates with the polishing cylinder 33 to define therebetween a polishing chamber 39. The polishing chamber 39 has an inlet 40 formed at its one end and an outlet 41 formed at its other end. The supply hopper 32 is disposed above the inlet 40, and a pressure plate 43 urged by a weight 42 is disposed at the outlet 41. A screw feeder 44 having a screw wing thereon is attached to the hollow main shaft 34 beneath the inlet 40. The perforated polishing cylinder 33 is surrounded with a bran collecting chamber 45. A lower portion of the bran collecting chamber 45 is communicated with a bran collecting duct 47 and an exhaust fan 48 via a bran collecting hopper 46.

The moisture adding section of the humidifying wheat polisher 17 is constructed as described below. A binary fluid nozzle 49 is disposed so that its nozzle hole faces the opening one end of the hollow main shaft 34. A blast pipe 50 connected at its one end to the binary fluid nozzle 49 is communicated with an air compressor 52 via an air filter 51. A water suply pipe 57 connected at its one end to the binary fluid nozzle 49 is communicated with a water tank 56 via an electromagnetic valve 53, a flow meter 54 and a flow regulating value 55.

A discharge shoot 59 is disposed at the discharge opening 41 of the humidifying friction-type wheat polisher 17 to supply wheat grains to the conditioning machine 5 via an elevator 57. The operation of the conditioning machine 5 is as described below. The concept of conditioning in accordance with this embodiment comprises conditioning in a broad sense, including cold conditioning. Cold conditioning, which is ordinarily called tempering, is performed in such a manner that raw-material wheat to which moisture has been added by a suitable means, e.g., the moisture supplying machine 3 is left in a tempering bin (not shown) at room temperature to increase the moisture content in the wheat. The raw-material wheat is thereby improved in flouring processibility. There are other kinds of conditioning in a restricted sense: warm conditioning, hot conditioning or stabilizer conditioning. In the case where the moisture content of the raw-material wheat is high, e.g., 20% or higher, drying may be included in the conditioning herein referred to. In other words, the conditioning comprises a processing step wherein the physical and chemical properties of raw-material wheat including the moisture content are optimized for milling or, more specifically, for crushing in a roll mill or machine to which the raw-material wheat is supplied first.

Figure 2:
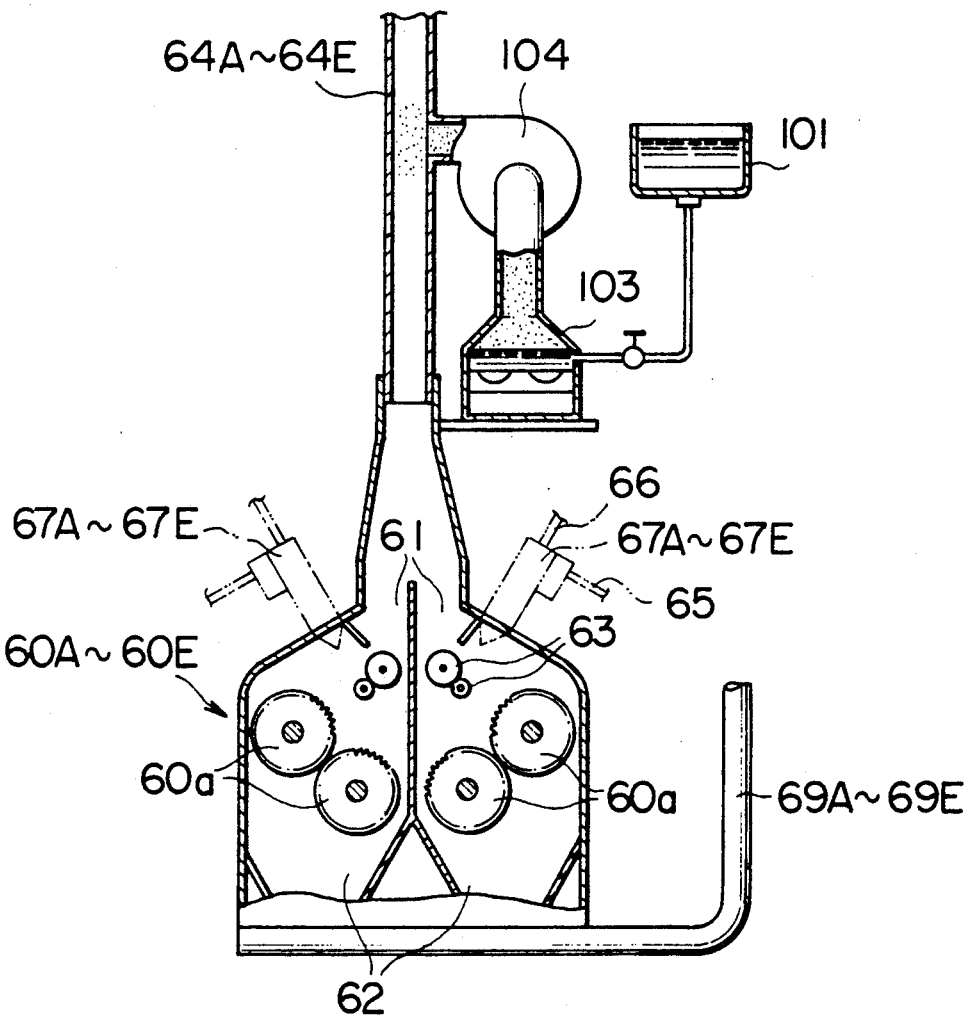
FIG. 2 is an enlarged cross-sectional view of a humidifying device which may be adopted in the system of FIG. 1.

Next, a flour milling system 2 will be described below. This system has five crushing stages, that is, includes crushing roll mills 60A to 60E. This group of roll mills is called a breaking system, and operations of the roll mills 60A to 60E ar called first braking (1B), second breaking (2B), ... and fifth breaking (5B). Surfaces of breaking rolls 60*a* of the roll mills 60A to 60E are formed with a tooth profile. The number of teeth in the roll surface, the tooth profile thereof, the combination of tooth profiles and the angle of torsion of teeth are changed with respect to the breaking stages while enabling a pair of rolls 60*a* to rotate at different speeds in opposite directions. Ordinarily, each of the roll mills 60A to 60E may be constructed as a composite roll mill by using two pairs of breaking rolls 60*a* (refer to FIG. 2) in such a manner that an outlet 62 is formed below the pair of rolls 60*a*, and feed rolls 63 are interposed between the inlet 61 and the corresponding pair of rolls 60*a* to make the distribution of supplied raw-material over the nip between the rolls 60*a* uniform.

Supply shoots 64A to 64E through which wheat grains or pulverized or powdery wheat grains (hereinafter referred to as "stock") flow downward are connected to the inlets 61 of the roll mills 60A to 60E. In an embodiment of FIG. 1, moisture adding devices for adding moisture to wheat grains or stock are connected to intermediate portions of the supply shoots 64A to 64E. More specifically, blast pipe 65 connected at its one end to an air compressor (not shown) and a water supply pipe 66 connected at its one end to a water tank (not shown) are connected at their other ends to each of binary fluid nozzles 67A to 67E (refer to the moisture adding section of the humidifying friction-type wheat polisher 17 shown in FIG. 3) which have nozzle holes opened toward the interiors of the supply shoots 64A to 64E. In the embodiment of FIG. 1, the binary fluid nozzles 67A to 67E are connected to the supply shoots 64A to 64E for spraying water to the grains passing through the supply shoots. However, the binary fluid nozzles 67A to **67*e* may be connected to the roll mills 60A to 60E as shown by dotted lines in FIG. 2**, so as to spray water directly into the roll mills.

The outlets 62 of the roll mills 60A to 60E and inlets of cyclone collectors 68A to 68E are connected to each other by upward feed pipes 69A to 69E formed as pneumatic carriers. A rotary type of air lock valve 70 is attached to a lower hopper portion of each of the cyclone collectors 68A to 68E. An upper end portion of an inner cylinder of each of the cyclone collectors 68A to 68E is communicated with an inlet of a dust collecting fan 72A via a dust collecting duct 71. An outlet of the dust collecting fan 72A is connected to a bag filter 73A.

Breaking sifters 74A to 74E for sifting or screening the stock crushed by the roll mills 60A to 60E are disposed below the cyclone collectors 68A to 68B. These sifters are called a first breaking sifter (1BS), ... and a fifth breaking sifter (5BS). Each of the first and second breaking sifters 74A and 74B has an upper screen, two intermediate screens and a lower screen arranged in the vertical direction and respectively formed of coarse metallic meshwork 75 of a small mesh number, fine metallic meshwork 76 of a larger mesh number, medium-fine gauze 77 and silk 78. The third breaking sifter 74C has upper, middle and lower screens formed of medium-fine metallic meshwork 79 of a middle mesh number, fine gauze 80 of a larger mesh number and silk 78. The fourth breaking sifter 74D has upper and lower screens formed of fine metallic meshwork 76 and silk 78. Similarly, in the fifth breaking sifter 74E, screens formed of fine metallic meshwork 76, fine gauze 80 and silk 78 are placed successively.

The milling and sifting system or grading system is thus constructed from the milling or breaking system and the breaking sifters 74A to 74E. Below these systems, a purification system for sorting or selecting (purifying) starch and gluten-parenchyma particles contained in the stock is provided. The purification system in which both sifting or screening selection and air selection are performed is constituted by purifiers 81A to 81D. Each of the purifiers 81A to 81D has at its bottom a first outlet 82, a second outlet 83 and an over outlet 84 disposed in this order from the suply side. A coarse-mesh screen 85 of a comparatively small mesh number is stretched in the purifier 81A, a fine-mesh screen 86 of a comparatively large mesh number is stretched in the purifier 81D, and a medium-mesh sieve 87 is stretched in each of the purifiers 81B and 81C. Each of the screens 85 to 87 is divided into four sections, and the mesh width is successively increased from the supply side toward the over outlet 84. Each of the screens 85 to 87 is inclined by 3° to 4° so as to be lowered at the over outlet 84.

A reduction system arranged below the purification system will be described below. The reduction system is provided with roll mills 88A to 88G having pairs of rolls **88*a* with smooth surfaces rotated at different speeds in opposite directions. (Details of these mills will not be described because they are substantially the same as those of the crushing roll mills 60A to 60E). Cyclone collectors 89A to 89G are disposed above the roll mills 88A to 88*g*. Discharge sections of the roll mills 88A to 88G and inlets of the cyclone collectors 89A to 89G are communicated with each other via upward feed pipes 90A to 90G. An upper end portion of an inner cylinder of each of the cyclone collectors 89A to 89G is communicated with an inlet of a dust collecting fan 72B via a dust collecting duct 91. An outlet of the dust collecting fan 72B is connected to a bag filter 73B**.

The reduction system intended mainly to extract finished flour has a sizing stage where the purified stock (semolina) supplied as an intermediate product from the above-described systems, i.e., mainly from the purification system is milled by the roll mills 88A to 88C (called sizing rolls 1SR to 3SR) into a stock of a mesh size of less than about 60 μm (middlings), and a middling stage where the middlings formed in the sizing stage so as to become easier to mill are further milled into flour by the roll mills 88D to 88G (called middling rolls 1MR to 4MR). The roll mill 88C at the end of the sizing stage is specifically called a tailing roll TR. Correspondingly, sifters disposed with the roll mills 88A to 88G are called sizing sifters (SS), tailing sifter (TS) and middling sifters (MS). That is, sizing sifters 93A (1SS) and 93B (2SS) are disposed below the cyclone collectors 89A to 89B with air lock valves 92 interposed therebetween, a failing sifter 94 (TS) is disposed below the cyclone collector 89A with an air lock valve 92 interposed therebetween, and middling sifters 95A to 95D (1MS to 4MS) are disposed below the cyclone collectors 89D to 89G with air lock valves 92 interposed therebetween. Each of the sizing sifters 93A and 93B has upper, middle and lower screens arranged in the vertical direction and respectively formed of fine metallic meshwork 75, fine gauze 76 and silk 78. Similarly, the tailing sifter 94 has upper, middle and lower screens formed of coarse gauze 96, fine gauze 80 and silk 78. Screens formed of medium coarse gauze 97 and silk 78 are stretched in the middling sifter 95A (1MS), screens formed of medium-fine gauze 77 and silk 78 in the middling sifter 95B (2MS), and screens formed of fine gauze 80 and silk 78 in the middling sifter 95C (3MS). A screen formed of silk 78 is stretched in the middling sifter 95D (4MS). The roll mill 88C called a tailing machine is specifically provided with a binary fluid nozzle 67F connected to blast pipes 65 and 66 (refer to FIG. 2). The binary fluid nozzle 67F may be connected directly to the roll mill 88C as shown by a solid line in FIG. 1 for spraying water directly into the roll mill 88C, and alternatively it may be connected to a wheat grain supply shoot for the roll mill 88C as shown by a dotted line for spraying water to the grains passing through the latter supply shoot FIG. 1.

Bran dusters 98A and 98B having brushes rotatably disposed in metallic mesh cylinders and adapted for taking large particles (gluten) of the surface portions of the grains out of the rolled stock are disposed at the downstream ends of the breaking system and the reduction system. A dust sifter 99 for further classifying the stock from which gluten has been removed by the bran dusters 98A and 98B is disposed above the bran dusters 98A and 98B. The dust sifter 99 has screens formed of fine gauze 80 and silk 78. A cyclone collector 68F with an air lock valve 70 and an upward feed pipe 69F are also disposed to connect the bran dusters 98A and 98B and the dust sifter 99.

Operation of this embodiment will be explained below. First, in the pretreatment system 1, raw-material wheat (well-selected wheat free from extraneous substance) having a moisture content of 13 to 14% which value corresponds to a standard in Japan is thrown into the moisture supplying machine 3 through the inlet 6 thereof, and wheat grains in the trough 8 are moistened by water supplied through the jet nozzle 12 as they are transported while being agitated by the screw 9. In the wheat grains which have received moisture while being agitated, moisture permeates into the surface portions of the grains each including layers of pericarp, testa, exosperm and aleuron, and the surface portions are thereby softened. In the description given hereinafter, the term "surface portions" of the grains means the portions of the grains including the abovementioned layers. The amount of moisture added to the wheat grains in the moisture adding section 10 may be varied. Preferably, it may be changed on the basis of the rate at which wheat grains flow by observing this flow rate through a flow meter (not shown). The temperature of water may be increased by the heater 14 in order to further promote the absorption.

The wheat grains having the surface portions softened by the moisture supplying machine 3 are transported by the elevator 15 to the wheat polishing machine 4. In the wheat polishing machine 4, the wheat grains are first thrown into the supply hopper 24 of the grinding-type wheat polisher 16 and are then supplied to the polishing chamber 21 by the feeding roll 27 to be polished by the grinding roll 20. The surface portions of the wheat grains other than those located in furrows are crushed into fine pieces and scraped off by the emery on the peripheral surface of the grind roll 20 rotating at a comparatively large peripheral speed (e.g., 600 mm/min or higher). The wheat grains discharged from the polishing chamber 21 by displacing the pressure plate 25 are transported to the elevator 31, are thrown into the supply hopper 32 of the humidifying polisher 17, and are supplied to the polishing chamber 39 by the screw feeder 44. In the polishing chamber 39, the wheat grains are moved under a comparatively high pressure (e.g., 200 g/cm$^2$ or higher) by the agitation projections 35 of the frictionally polishing roll 37 rotating at a peripheral speed equal to or lower than half the peripheral speed of the grinding roll 20 of the grinding-type wheat polisher 16 so that frictions are produced between the wheat grains. At this time, moisture in a mist form injected from the nozzle hole of the binary fluid nozzle 49 into the hollow main shaft 34 flows into the inner hollow space of the frictionally polishing roll 37 through the air holes 38 formed in the peripheral wall of the hollow main shaft 34, and is jetted into the polishing chamber 39 through the slots 36, thereby humidifying surface portions of the wheat grains and increasing the frictions therebetween. An amount of the surface portions still left on the wheat grains is thereby removed, and the endosperm parts except aleuron layers of the grains are exposed. The added moisture exits out of the perforated polishing cylinder 33 together with the bran by the air flows jetted through the slots 36.

The wheat grains (polished grains) discharged from the humidifying fiction-type wheat polisher 17 through the outlet 41 thereof are transported to the elevator 57 and then to conditioning machine 5. In the conditioning machine 5, the wheat grains are humidified by a moisture adding device (not shown) and are thereafter left in a tempering tank or the like for 24 to 48 hours, thereby making the moisture permeate uniformly to starch and gluten-parenchyma of each wheat grain. In this step, as described above, the moisture content is adjusted to 15 to 16% which value is most suitable for the first breaking irrespective of whether this conditioning is cold, warm or hot conditioning.

The wheat grains conditioned by the conditioning machine 5 are supplied with moisture in a mist form from the spray nozzle 67A in the supply shoot 64A that is the feed passage extending to the crushing roll mill 60A (1B) of the breaking system. 30 to 120 minutes after this operation, that is, the moisture has permeated to starch and gluten-parenchyma of each endosperm part, the wheat grains undergo break-rolling or first breaking effected by the crushing roll mill 60A, thereby being crushed in such a manner that they are spread widely. Since surface portions at the furrow portions of the wheat grains in which the moisture content has been increased to about 16% have an increased strength while the starch and gluten-parenchyma parts of these grains are soft, the starch and gluten-parenchyma parts are crushed by a comparatively low pressure by the roll mill 60A while the surface portions of the grains in the furrow portions are prevented from fracturing into fine pieces. The stock obtained by this breaking is supplied via the upward feed pipe 69A in a peumatic transportation manner, is separated from air by the cyclone collector 68A, and is supplied to the first breaking sifter 74A via the air lock valve 70.

In the first breaking sifter 74A, the stock is classified by vibration of the sifter into a mass consisting of starch and gluten-parenchyma particles, a mass of particles (semolina) which is a mixture of starch and gluten-parenchyma particles with surface portions of the grains attached thereto and fine particles of the surface portions, a mass of intermediate particles (middlings), a mass of fine particles (dust), and a mass of powder finished as the product. A stock left on the uppermost coarse metallic mesh screen 75 (called "over") is introduced downward via the supply shoot 64B into the crushing roll mill 60B and undergoes second breaking. At this time, moisture in a mist form is supplied through the spray nozzle 67B to the stock in the supply shoot 64B, and the stock is thereby slightly humidified while flowing downward through the shoot 64B, thereby resupplying an amount of moisture corresponding to that lost during operation or transportation through the crushing roll mill 60A, the upward feed pipe 69A, the cyclone collector 68A and the breaking sifter 74A.

The stock thereby resupplied with moisture until the moisture content again reaches 16% undergoes second breaking in the crushing roll mill 60B and is thereafter supplied to the breaking sifter (2BS) 74B via the upward feed pipe 69B and the cyclone collector 68B. The breaking sifter 74B is of the same construction as that of the breaking sifter (1BS) 74A. A stock left on the uppermost coarse metallic mesh screen 75 of the breaking sifter 74B is supplied as "over" to the next crushing roll mill 60C. Stocks on the fine metallic mesh screens 76 below the mesh screens 75 (called coarse semolina) of the breaking sifters 74A and 74B are supplied to the purifier 81A (1P) to be purified together, and stocks on the medium-fine gauze screens 77 below the mesh screens 76 (called fine semolina) are supplied to the purifier (2P) 81B. Stocks on the lowermost silk screens 78 (called coarse middlings) are supplied to the roll mill 88A (1SR) in the sizing stage while stocks which have passed through the silk screens 78 are collected as finished flour.

The stock left on the upper most coarse metallic mesh screen 75 of the breaking sifter 74B (2BS) is thrown into the crushing roll mill 60C after flowing downward through the supply shoot 64C, and undergoes third breaking. The stock flowing downward through the supply shoot 64C is also humidified by the spray nozzle 67C and is thereby resupplied with an amount of moisture corresponding to that lost during the second breaking and in the second breaking sifter, thereby enabling production of semolinas by maintaining the moisture content of the stock at 16% and spreading and crushing wheat particles with an improved efficiency without excessively fracturing pericarp pieces, as in the case of the first and second breaking.

The stock produced by the third breaking is upwardly transported through the upward feed pipe 69C to the cyclone collector 68C and is supplied to the breaking sifter 74C via the air lock valve 70. A stock left on the upper most medium metallic mesh screen 79 of the breaking sifter 74C is supplied for fourth breaking, a stock on the middle fine gauze screen 80 to the roll mill 88B (2SR) in the sizing stage, and a stock on the lowermost silk screen 78 to the roll mill 90C corresponding to the tailing stage. A stock which has passed through the lowermost silk screen 78 is taken out as finished flour.

The stock left on the uppermost medium metallic mesh screen 79 of the third breaking sifter 74C (3BS) and containing a large proportion of pieces of the surface portions of the grains flows downward through the supply shoot 64D, is humidified by the spray nozzle 67D and is thereby resupplied with moisture so that the pieces of the surface portions become stronger. The stock is thereafter thrown into the crushing roll mill 60D for fourth breaking. The fourth breaking and subsequent breaking operations are performed mainly to separate starch and gluten-parenchyma parts (hereinafter referred to as "inner portions of the grains") from of the pieces of the surface portions of the grains. The stock passed through the crushing roll mill 60D (4BR) is supplied to the breaking sifter 74D via the upward feed pipe 69D and the cyclone collector 68D. A stock left on the upper fine metallic mesh screen 76 of the breaking sifter 74D (4BS) is supplied for the next breaking, and a stock on the silk 78 to the final roll mill (4MR) 88G in the middling stage. A stock which has passed through the silk 78 is collected as finished flour.

A stock left on the upper fine metallic mesh screen 76 of the fourth breaking sifter 74D (4BS) is humidified by the spray nozzle 67E while flowing downward through the supply shoot 64E so as to resupplied with an amount of moisture corresponding to that lost during breaking at the preceding stage. Thereafter, separation of residual from inner surfaces of the pieces of the surface portions of the grains is effected by the crushing roll mill 60E (5BR). The stock passed through the crushing roll mill 60E is supplied to the final breaking sifter 74E (5BS) via the upward feed pipe 69E and the cyclone collector 68E. Both stocks on the upper fine, metallic mesh screen 76 and the middle fine gauze screen 80 of the breaking sifter 74E are supplied to the bran duster 98A, and particles of the inner portions of the grains are separated from pieces of the surface portions of the grains by the effect of friction with the brushes and the metallic meshes and are delivered to the dust sifter 99 while pieces of the surface portions from which inner portions of the grains have been removed are taken out of the machine as gluten. A stock on the silk screen 78 is supplied together with the stock on the silk screen 78 of the breaking sifter 74D (4BS) to the final roll mill 88G (4MR) in the middling stage. A stock which has passed through the silk screen 78 is collected as finished flour.

Of particles of the inner portions of the grains supplied from the bran dusters 98A and 98B to the dust sifter 99 via the upward feed pipe 69F and the cyclone collector 68F, particles other than those collected as finished flour after passing through the fine gauze screen 80 and the silk screen 78 are removed as gluten to the outside of the system.

Next, the operations of the purification system and the reduction system will be described. Coarse semolina particles transported from the upper sides of the fine metallic mesh screens 76 of the breaking sifter 74A (1BS) and the breaking sifter 74B (2BS) to the purifier 81A (1P) form fluidized beds by the effect of small vibrations in the longitudinal direction and by the transporting effects of flows from below the coarse screen 85. At this time, semolina particles having a larger specific gravity sink into a lower bed while small pieces of surface portions of the grains having a smaller specific gravity move toward an upper bed (bedding), only pieces of the surface portions of the grains rise to the upper surface (classification) by air flows from below, and semolina particles are sieved in such a manner that those smaller than the mesh of the coarse screen 85 falls downward through the first and second outlets 82 and 83. A stock thus falling downward through the first outlet 82 of the purifier 81A (1P) and stocks on the silk screens 78 of the breaking sifter 74A (1BS) and the breaking sifter 74B (2BS) are milled into fine particles by the roll mill 88A (1SR) in the sizing stage.

The stock milled by the roll mill 88A (1SR) is upwardly transported to the cyclone collector 89A through the upward feed pipe 90A and is supplied to the sizing sifter 93A (1SS) via the air lock valve 92. A stock on the upper fine metallic mesh screen 75 of the sizing sifter 93A is transported to the tailing roll mill 88C (TR), a stock on the middle fine gauze screen 76 to the purifier 81C (3P), and a stock on the lower silk screen 78 to the purifier 81D (4P). A stock which has passed through the silk screen 78 is collected as finished flour.

The stocks (fine semolina) left on the medium-fine gauze screens 77 of the breaking sifter 74A (1BS) and the breaking sifter 74B (2BS) are supplied to the purifier 81B (2P). Stocks discharged through the second outlets 83 and through the over outlets 84 of the purifiers 81A to 81D and the stock on the fine gauze screen 80 of the breaking sifter 74C (3BS) are supplied to the roll mill 88B (2SR) in the sizing stage. In the roll mill 88B having substantially the same functions as the roll mill 88A, the purified semolina is changed into fine semolina particles having a mesh size of not larger than 60 μm (middlings) and is thereby made easy to mill at the next middling stage. The fine semolina particles thereby obtained are supplied to the sizing sifter 93B (2SS) via the upward feed pipe 90B and the cyclone collector 89B.

A stock left on the uppermost fine metallic mesh screen 75 of the sizing sifter 93B is thrown into the tailing roll mill 88C (TR) together with the stock on the uppermost fine metallic mesh screen 75 of the sizing sifter 93A (1SS) and the stock on the lowermost silk screen 78 of the breaking sifter 74C (3BS). The stocks that are supplied from the sizing stage and from the upper side of the silk screen 78 of the third breaking sifter 74C and that contain a large proportion of coarse pieces of the surface portions of the grains are milled by the roll mill 88C provided in this mill 88C. This humidifying operation facilitates separation of the inner portions of the grains and makes the pieces of the surface portions of the grains stronger, thereby enabling the pieces of the surface portions to be taken out at the succeeding stage as gluten pieces having a medium size without being broken into excessively small pieces. The roll mill 88C may be provided with a drawing fan for removing excessive moisture. A stock left on the middle fine gauze screen 76 of the sizing sifter 93B is supplied to the roll mill 88F (3MR) in the middling stage, and a stock on the lowermost silk screen 78 to the roll mill 88E (2MR) in the middling stage. A stock which has passed through the silk 78 is collected as finished flour.

The stock milled by the tailing roll mill 88C (TR) is supplied to the tailing sifter 94 (TS) via the upward feed pipe 90C and the cyclone collector 89C. Stocks left on the coarse gauze screen 96 and the middle fine gauze screen 80 are transported to the final roll mill 88G (4MR) in the middling stage, and a stock on the lower silk screen 78 is transported to the roll mill 88F (3MR) in the middling stage. A stock which has passed through the silk 78 is collected as finished flour.

The primary roll mill 88D (1MR) in the middling stage is supplied with stocks from the first outlets 82 of the purifiers 81B to 81D. The stock milled by the roll mill 88D is supplied to the middling sifter 95A (1MS) via the upward feed pipe 90D and the cyclone collector 89D. A stock left on the upper medium-caorse gauze screen 97 of the middling sifter 95A is supplied to the roll mill 88C. A stock left on the lower silk screen 78 is transported to the roll mill 88E (2MR) of the middling stage together with a stock on the silk screen 78 of the sizing sifter 93B (2SS), and a stock which has passed through the silk screen 78 is collected or recovered as finished flour.

The stock milled by the roll mill 88E is transported to the middling sifter 95B (2MS) via the upward feed pipe 90E and the cyclone collector 89E. A stock on the upper medium-fine gauze screen 77 of the middling sifter **95*b* is transported to the roll mill 88C of the tailing stage, and a stock on the lower silk screen 78 is transported to the roll mill 88F (3MR) of the middling stage together with stocks on the middle fine gauze screen 76 of the sizing sifter 93B (2SS) and the lower silk screen 78 of the tailing sifter 94. A stock which has passed through the silk screen 78** is collected as finished flour.

A stock milled by the roll mill 88F is transported to the middling sifter 95C (3MS) via the upward feed pipe 90F and the cyclone collector 89F. A stock left on the upper fine gauze screen 80 of the middling sifter **95*c* is transported to the tailing roll mill 88C, and a stock on the lower silk screen 78 is transported to the final roll mill 88G together with stocks on the upper coarse gauze screen 96 and the middle fine gauze screen 80 of the tailing sifter 94 and the stocks on the lower silk screens 78 of the breaking sifter 74D (4BS) and the breaking sifter 74E** (5BS).

The stock milled by the roll mill 88G is transported to the final middling sifter 95D (4MS) via the upward feed pipe 90G and the cyclone collector 89G. A stock which has passed through the silk screen 78 of the middling sifter 95D is collected as finished flour, and the rest of the stock is supplied to the bran duster 98B. The bran duster 98B supplies particles of the inner portions of the grains separated from pieces of the surface portions thereof to the dust sifter 99 via the upward feed pipe 69F and the cyclone collector 68F. Pieces of the grain surface portions from which grain inner portions have been removed are taken out of the machine as gluten. Stocks left on the upper fine gauze screen 80 and the lower silk screen 78 of the dust sifter 99 are removed as gluten, and a stock which has passed through the silk screen 78 is collected as finished flour.

An auxiliary milling machine for breaking a stock in the form of flakes formed by pressing between smooth rolls may be disposed immediately after each of the roll mills 88D to 88G (1MR to 4MR) in the middling stage. The moisture adding device or humidifying devices are not limited to the binary fluid nozzles 67A to 67F. A humidifying device such as that shown in FIG. 2 may be applied instead of this type of nozzle in such a manner that a mist generator incorporating an ultrasonic vibrator element 103 and communicated with a water tank 101 is connected to an inlet of a fan 104, and an outlet of the fan 104 is connected to the supply shoot for each roll mill or directly to each roll mill, thereby adding atomized water to the crushed or milled material.

Figure 4:
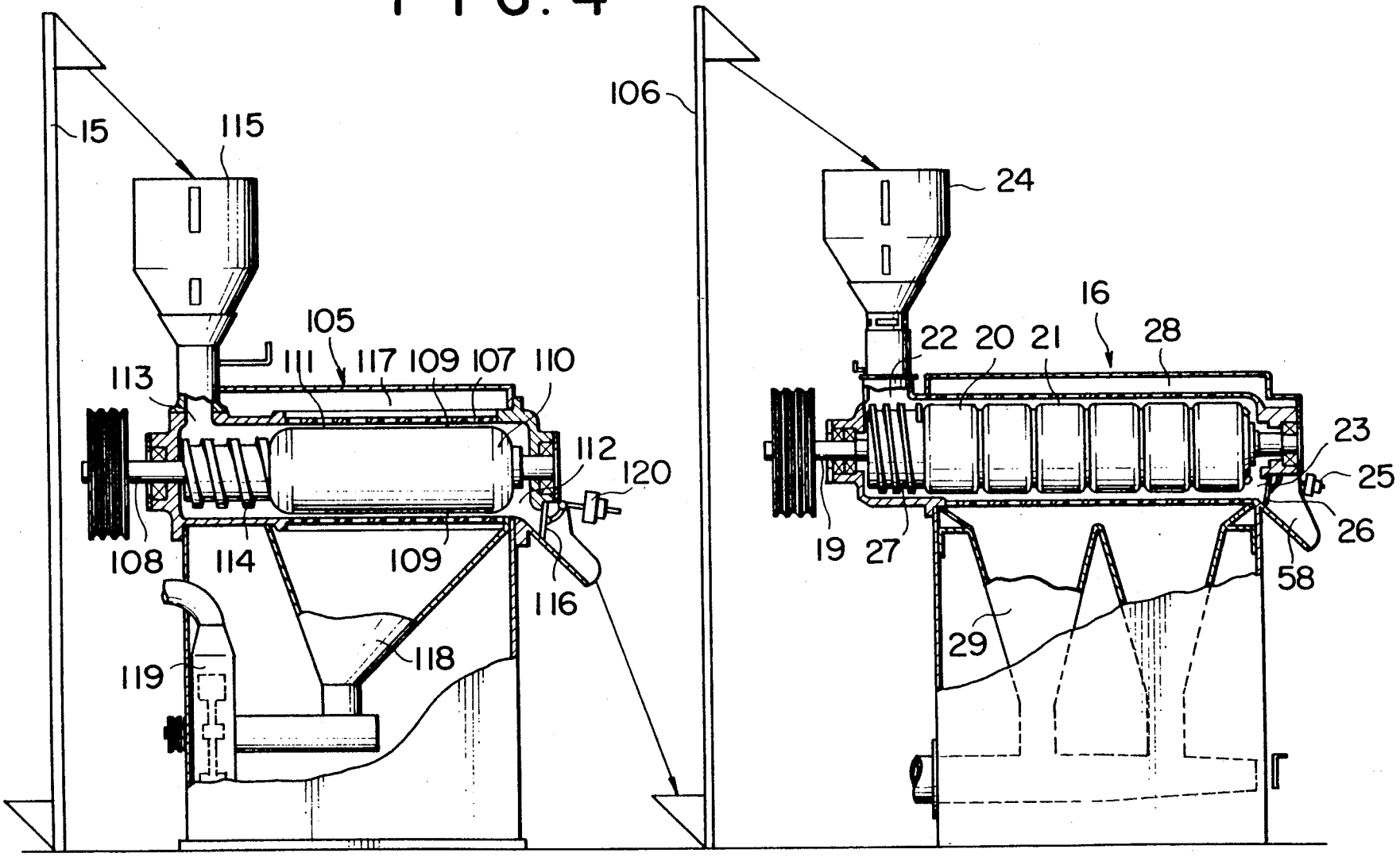
FIG. 4 is an enlarged cross-sectional view of another example of the wheat polishing machine.

Another example of the wheat polishing machine 4 will be described below with reference to FIG. 4. In this case, the wheat polishing machine 4 is constituted by a friction-type wheat polisher 105 and the above-described type of grinding-type wheat polisher 16 connected by an elevator 106. The friction-type wheat polisher 105 is connected to the moisture supplying machine at the preceding stage by the elevator 15. The friction-type wheat polisher 105 has a main shaft 108 which passes through a perforated polishing cylinder 107 and is rotatable about a substantially horizontal axis. A frictionally polishing roll 110 having thereon a plurality of agitation projections 109 is attached to the main shaft 108. The perforated polishing cylinder 107 cooperates with the frictionally polishing roll 110 to define therebetween a polishing chamber 111. The polishing chamber 111 has at its one end an outlet 112 and at its other end an inlet 113. A screw feeder 114 is attached to the main shaft 108 beneath the inlet 113. A supply hopper 115 is disposed above the inlet 113. A pressure plate 116 urged by a weight 120 is disposed at the outlet 112. A lower portion of a bran collecting chamber 117 surrounding the perforated polishing cylinder 107 is communicated with a bran collecting hopper 118 which in turn is connected to an exhaust fan 119.

The grinding-type wheat polisher 16 of this machine is the same as that described above. Portions of this wheat polisher are therefore indicated with the same reference characters, and the same description will not be repeated. Specific operation of this example will be described below. Wheat grains supplied with moisture from the moisture supplying machine 3 are transported to the supply hopper 115 of the friction-type wheat polisher 105 by the elevator 15 and are then supplied to the polishing chamber 111 by the screw feeder 114. The wheat grains are maintained under a comparatively high pressure in the polishing chamber 111 by the pressure plate 116, and hard trichomes and the like are removed from the surfaces of the wheat grains by the effects of friction between the grains and friction between the grains and the surface of the perforated polishing cylinder 107. At the same time, the surface portion of each wheat grain is partially scraped off by the same effects.

Wheat grains from which trichomes and the like have been removed and which are made easier to polish are transported to the grinding-type wheat polisher 16 and undergo grinding effected by the grinding roll 20, thereby removing grain surface portions except those located in furrow portions. Wheat grains thus polished are transported to the milling system after undergoing conditioning in the conditioning machine 5, as in the case of the above-described embodiment.

The present invention is advantageous in the following respects. The material milled in the milling system is humidified so as to be resupplied with an amount of moisture corresponding to that lost during repeated milling and transporting operations of the rolls, the transportation means and classification means and so forth, thereby enabling the wheat grains to have a moisture content most suitable for milling whenever crushed or milled by the rolls so that the desired strength of the surface portions of the wheat grains can be maintained while the inner portion of the same, i.e., starch and gluten-parenchyma parts, are softened. The possibility of the grain surface portions being broken into small pieces and mixed in particles of the grain inner portions is thereby reduced. The process in accordance with the invention thus enables production of finished flour improved in commercial value with an improved efficiency and with a high yield by extracting a highly purified and softer particles having improved qualities. The efficiency of operation of the rolls can also be improved because heating of the rolls is limited.

Because the raw-material wheat is milled after being polished, milling can be performed under a reduced load while classification and purification are facilitated, resulting in an improvement in the quality of the product.

In the case where polishing is performed by the grinding-type polishing and the humidifying friction-type polishing, surface portions of wheat grains are substantially completely polished by the humidifying friction-type polishing. In the case of the combination of friction-type polishing and grinding-type polishing, hard trichomes and the like are first removed from the surfaces of wheat grains by friction-type polishing, thereby facilitating subsequent grinding-type polishing operations.

In the case where moisture supply, polishing and conditioning are performed as pretreatment steps, supply of moisture makes it easy to exfoliate the grain surface portions during subsequent polishing, and moisture is again added to wheat grains after the polishing so that the wheat grains are resupplied with an amount of moisture lost during the polishing and that moisture uniformly permeates into inner portion of each wheat grain, thereby softening starch and gluten-parenchyma parts and strengthening the grain surface portions at the furrow portions. The grain surface portions are thereby prevented from being broken into excessively small pieces while separation of the grain surface portions and the grain inner portions from each other is facilitated, thereby enabling production of finished flour highly purified and having improved qualities.

If a humidifying device having an ultrasonic vibration element is adopted as the device for humidifying milled material, milled particles can be supplied with moisture in the form of atomized water uniformly over their surfaces. In the case where humidifying device are binary fluid nozzles, the humidifying devices can readily be disposed at the rolls or the paths through which the milled material is transported.

What is claimed is:

1. A system for flouring grains comprising:

pretreatment means including means for polishing the grains to produce polished grains;

means for milling and sifting the polished grains to provide a flour having a desired mesh size; and means provided in association with said milling and sifting means for adding moisture to the grains milled in said milling and sifting means, wherein said polishing means includes a perforated polishing cylinder and a grinding roll inserted into said polishing cylinder, said polishing cylinder cooperating with said grinding roll to define therebetween a polishing chamber.

2. A system as defined in claim 1, wherein said milling and sifting means includes first milling means for milling the grains to form powdery grains, first sifting means for sifting the powdery grains and classifying the latter according to mesh size thereof, second milling means adapted to receive from said first sifting means the powdery grains of a predetermined mesh size and mill the grains received therein, and second sifting means for sifting the grains milled by said second milling means to provide the flour; and wherein said moisture adding means is provided in association with at least one of said first milling means and said second milling means.

3. A system as defined in claim 2, further comprising purifying means including at least one purifier adapted to receive from said first sifting means the powdery grains of a predetermined mesh size and sort out from the powdery grains received therein the grains having large specific gravity and small mesh size, said second milling means being adapted to receive and mill the grains sorted out by said purifying means.

4. A system as defined in claim 2, wherein said first milling means includes a plurality of roll mills, said first sifting means includes a plurality of sifters, said roll mills and said sifters being alternately arranged to repeatedly alternately mill and sift the grains, and said moisture adding means is connected to at least one of said roll mills for supplying moisture directly into said at least one roll mill.

5. A system as defined in claim 2, wherein said first milling means includes a plurality of roll mills, said first sifting means includes a plurality of sifters, said roll mills and said sifters being alternately arranged to repeatedly alternately mill and sift the grains, and said moisture adding means is connected to a grain supply shoot for at least one of said roll mills for adding moisture to the grains passing through said grain supply shoot.

6. A system as defined in claim 2, wherein said second milling means includes a plurality of roll mills, said second sifting means includes a plurality of sifters, said roll mills and said sifters being alternately arranged to repeatedly alternately mill and sift the grains, and said moisture adding means is connected to at least one of said roll mills for supplying moisture directly into said at least one roll mill.

7. A system as defined in claim 2, wherein said second milling means includes a plurality of roll mills, said second sifting means includes a plurality of sifters, said roll mills and said sifters being alternately arranged to repeatedly alternately mill and sift the grains, and said moisture adding means is connected to a grain supply shoot for at least one of said roll mills for adding moisture to the grains passing through said grain supply shoot.

8. A system as defined in claim 1, wherein said moisture adding means includes a moisture adding device having an ultrasonic vibration element.

9. A system as defined in claim 1, wherein said moisture adding means includes a binary fluid nozzle.

10. A system as defined in claim 1, wherein said polishing means includes a perforated polishing cylinder and a grinding roll inserted into said polishing cylinder, said polishing cylinder cooperating with said grinding roll to define therebetween a polishing chamber.

11. A system as defined in claim 1, wherein said pretreatment means further includes moisture supplying means for supplying moisture to the grains to be introduced and polished in said polishing means.

12. A system for flouring grains comprising:

pretreatment means including means for polishing the grains to produce polished grains;

means for milling and sifting the polished grains to provide a flour having a desired mesh size; and means provided in association with said milling and sifting means for adding moisture to the grains milled in said milling and sifting means, wherein said polishing means includes a grinding-type grain polisher having a grinding roll covered with emery, and a humidifying friction-type grain polisher having a moisture adding device for humidifying the grains introduced in a polishing chamber of said humidifying friction-type grain polisher.

13. A system for flouring grains comprising:

pretreatment means including means for polishing the grains to produce polished grains;

means for milling and sifting the polished grains to provide a flour having a desired mesh size; and means provided in association with said milling and sifting means for adding moisture to the grains milled in said milling and sifting means, wherein said polishing means includes a friction-type grain polisher having a frictionally polishing roll with agitating projections, and a grinding-type grain polisher having a grinding roll covered with emery.

* * * * *